US006358077B1

(12) United States Patent
Young

(10) Patent No.: US 6,358,077 B1
(45) Date of Patent: Mar. 19, 2002

(54) G-LOAD COUPLING NUT

(75) Inventor: Thomas F. Young, Simi Valley, CA (US)

(73) Assignee: Glenair, Inc., Glendale, CA (US)

( * ) Notice: Subject to any disclaimer, the term of this patent is extended or adjusted under 35 U.S.C. 154(b) by 0 days.

(21) Appl. No.: 09/712,597

(22) Filed: Nov. 14, 2000

(51) Int. Cl.[7] ..... H01R 4/38
(52) U.S. Cl. ..... 439/321; 439/905
(58) Field of Search ..... 439/310, 312, 439/313, 319, 320, 321, 322, 323, 905

(56) References Cited

U.S. PATENT DOCUMENTS

| | | | | | |
|---|---|---|---|---|---|
| 4,484,790 | A | * | 11/1984 | Schildkraut et al. | 439/312 |
| 4,820,184 | A | * | 4/1989 | Brandes | 439/321 |
| 4,834,667 | A | * | 5/1989 | Flowler et al. | 439/321 |
| 5,035,640 | A | * | 7/1991 | Drogo | 439/321 |
| 5,192,219 | A | * | 3/1993 | Fowler et al. | 439/321 |
| 5,590,228 | A | * | 12/1996 | Gibola et al. | 385/56 |
| 5,683,263 | A | * | 11/1997 | Hsu | 439/319 |
| 6,086,400 | A | * | 7/2000 | Fowler | 439/321 |
| 6,203,370 | B1 | * | 3/2001 | Lee | 439/589 |

* cited by examiner

*Primary Examiner*—Tulsidas Patel
*Assistant Examiner*—Thanh-Tam T Le
(74) *Attorney, Agent, or Firm*—Katteb Muchin Zavis

(57) ABSTRACT

A backshell adapter assembly includes an adapter body, a coupling nut, a retaining ring and a one-piece shuttle mechanism. The one-piece shuttle mechanism is formed as a tubular member and is adapted to be received in a retaining groove on the adapter body. In order to facilitate loading of the one-piece shuttle into the retainer groove on the adapter body, the one-piece shuttle is cut along its length to enable the cut ends of the device to be spread apart in order to load the shuttle mechanism into the retaining groove on the adapter body. The one piece shuttle mechanism includes a thrust bushing portion and one or more concentrically formed spring arms that are adapted to provide axial loading in the direction of an electrical connector shell when the backshell adapter assembly is assembled to an electrical connector. In accordance with another feature of the invention, the one-piece shuttle design is amenable to being formed from high temperature composite materials which eliminates the corrosion problem and minimizes damage during various extreme conditions such as extreme vibration conditions to portions of the backshell adapter assembly which are normally formed from aluminum. Another important aspect of the invention is that the one-piece shuttle assembly minimizes the number of parts required and thus significantly reduces the manufacturing costs of such backshell adapter assembles.

14 Claims, 3 Drawing Sheets

G-LOAD COUPLING NUT

BACKGROUND OF THE INVENTION

1. Field of the Invention

The present invention relates to an accessory for an electrical connector and more particularly to a backshell adapter assembly which includes an adapter body formed with anti-rotation teeth, a threaded coupling nut, a retaining ring and a one-piece shuttle with one or more integrally formed spring arms that are adapted to provide an axial biasing force to force proper mating of the anti-rotation teeth on the adapter body relative to corresponding teeth on an electrical connector when the coupling nut is being secured thereto.

2. Description of the Prior Art

Backshell adapter assemblies are known in the art. Such backshell adapter assemblies normally provide a transition from a plurality of electrical conductors to an electrical connector. An example of such backshell adapter assemblies is disclosed in commonly-owned U.S. Pat. No. 5,580,278.

Known backshell adapter assemblies normally include an adapter body, normally tubular in shape, and a coupling nut. In order to secure the coupling nut relative to the adapter body, a retaining ring is normally used. The coupling nut is normally threaded onto an electrical connector. In order to prevent rotation of the backshell adapter assembly relative to the electrical connector, anti-rotation teeth are provided on the adapter body as well as on the electrical connector which interlock and prevent rotation of the coupling nut relative to the electrical connector, for example, as disclosed in commonly-owned U.S. Pat. No. 5,580,278.

If the interlocking teeth on the adapter body and the connector shell properly mate, rotation of the backshell adapter assembly relative to the electrical connector will be prevented. Unfortunately, false mating of the interlocking teeth on the adapter body and the connector shell is known to occur. The false mating can occur when the rotational force of the coupling nut resulting from threading the coupling nut onto the electrical shell causes radial forces on the backshell adapter assembly which causes the backshell adapter assembly to rotate resulting in the interlocking teeth engaging point to point. During such a condition, since the interlocking teeth are hidden from view, an installer may be unaware of the false mating. As such, such a configuration enables the installers to tighten the coupling nut to the desired torque level without being aware of the false mating thus defeating the anti-rotation feature of the backshell adapter assembly possibly resulting in rotation and loosening and even disengagement of the adapter body relative to the connector shell, for example, due to vibration.

Various solutions have been presented in the art to prevent false mating of the a interlocking teeth on the backshell adapter assembly with the interlocking teeth on the connector shell. These various solutions generally involve providing an axial force sufficient to overcome any rotational forces that occur during tightening of the coupling nut to force the interlocking teeth into engagement.

One such solution is illustrated in FIGS. 1 and 2. Referring to FIGS. 1 and 2, a known backshell adapter assembly is illustrated and generally identified with the reference numeral 20. The backshell adapter assembly 20 includes an adapter body 22, formed with anti-rotation teeth, aligned in an axial direction and generally identified with the reference numeral 24, a thrust bushing 26, a bellville washer 28, a coupling nut 30 and a pair of C-clips 27, which are adapted to be received in a retaining groove 29 on the thrust bushing 26, forming a retaining ring. The backshell adapter assembly 20 also includes an anti-decoupling mechanism to prevent the coupling nut 30 from rotating relative to the adapter body 22. The anti-decoupling mechanism includes a plurality of teeth 32 disposed in a radial direction which cooperate with one or more leaf springs 34, 36, disposed in an annular grove 38 in the coupling nut 30. The leaf springs 34, 36 include one or more tabs 40 that are adapted to engage the teeth 32 to prevent rotation of the coupling nut 30 relative to the adapter body 22.

As shown in FIG. 1, the thrust bushing 26 is disposed in an annular groove 42 on the adapter body 22. As discussed above, the C-clips 27 are received in the retention groove 29 on the thrust bushing 26 and form a retaining ring. The retaining ring is adapted to be received in an annular groove 44 on the coupling nut 30 in order to capture the coupling nut 30 relative to the adapter body 22 to prevent movement in an axial direction.

As shown in FIG. 1, the bellville washer 28 is disposed adjacent the retaining ring 26 in the annular groove 42 on the adapter body 22. In order to prevent false mating of the interlocking teeth 24 on the adapter body 22 with corresponding teeth on the connector shell (not shown), the bellville washer 28 is used.

More particularly, as the coupling nut 30 is threaded onto the connector shell (not shown) by way of the threads 46, the bellville washer 28 exerts an axial force in the direction of the arrow 44 which overcomes any anticipated radial forces which would tend to rotate the adapter body 22 which force the mating teeth 24 on the adapter body 22 into proper mating arrangement with the corresponding mating teeth on the connector shell.

U.S. Pat. No. 5,435,760 provides a similar solution. In particular, a bellville or wave washer is used to provide an axial force in the direction of the electrical connector to overcome any rotational forces on the adapter body to ensure proper seating on the adapter body and connector shell.

There are several problems with the solutions discussed above. In particular, both solutions utilize a wave or bellville washer, normally formed from tempered metal. As such, such washers are subject to corrosion and tend to vibrate severely and can damage to softer backshell materials, such as aluminum and high temperature thermoplastic composites. Another problem with the configuration illustrated in '760 patent is that the wave spring is tightened to a flattened condition to act as a retainer ring to capture the coupling nut which can permanently distort the wave washer causing it to lose its inherent memory.

The backshell adapter assembly 20 illustrated in FIGS. 1 and 2, solves the above-mentioned problem while also providing axial loading without the need to flatten the wave washer and use it as a retaining ring to axially couple the coupling nut to the adapter body. Indeed, as discussed above, the backshell adapter 20 illustrated in FIGS. 1 and 2 utilizes a thrust bushing with an annular groove for receiving one or more C-clips which act as a retaining ring thus obviating the need to use the bellville washer as a retaining ring.

Although the configuration illustrated in FIGS. 1 and 2 provides an adequate solution to the problems discussed above, the adapter assembly 20 illustrated in FIGS. 1 and 2 include a relatively large number of parts making it relatively expensive to manufacture. Indeed, as discussed above the prior art backshell adapter assembly 20 includes a two-piece shuttle mechanism which includes a thrust bushing and a belleville washer. Moreover, the belleville washer is made of metal and is subject to corrosion and vibration as discussed above. Thus there is a need for a backshell adapter assembly which prevents false mating of interlocking teeth on the adapter body relative to the connector shelf which is formed with less parts and is less expensive to manufacture.

SUMMARY OF THE INVENTION

Briefly, the present invention relates to a backshell adapter assembly which includes an adapter body, a coupling nut, a retaining ring and a one-piece shuttle mechanism. The one-piece shuttle mechanism is formed as a tubular member and is adapted to be received in a retaining groove on the adapter body. In order to facilitate loading of the one-piece shuttle into the retainer groove on the adapter body, the one-piece shuttle is cut along its length to enable the cut ends of the device to be spread apart in order to load the shuttle mechanism into the retaining groove on the adapter body. The one piece shuttle mechanism includes a thrust bushing and one or more concentrically formed spring arms that are adapted to provide axial loading in the direction of an electrical connector shell when the backshell adapter assembly is assembled to an electrical connector. In accordance with another feature of the invention, the one-piece shuttle design is amenable to being formed from high temperature composite materials which eliminates the corrosion problem and minimizes damage during various extreme conditions such as extreme vibration conditions to portions of the backshell adapter assembly which are normally formed from aluminum. Another important aspect of the invention is that the one-piece shuttle assembly minimizes the number of parts required and thus significantly reduces the manufacturing costs of such backshell adapter assemblies.

DESCRIPTION OF THE DRAWINGS

These and other advantages of the present invention will be readily understood to the following specification and attached drawing wherein.

DETAILED DESCRIPTION

The present invention relates to a backshell adapter assembly for interfacing a plurality of electrical conductors (not shown) to an electrical connector. As will be explained in more detail below, the backshell adapter assembly in accordance with the present invention is configured with an anti-decoupling feature to prevent the backshell adapter assembly from being decoupled from an electrical connector. Such anti-decoupling mechanisms normally include interlocking teeth formed on the adapter body and the electrical connector shell. In accordance with an important aspect of the invention, a one piece shuttle device is provided, which, as will be discussed in more detail below, provides an axial force in the direction of the electrical connector which overcomes the initial rotational force on the backshell adapter when the backshell adapter is being coupled to an electrical connector without the problems associated with the prior art discussed above. The one piece shuttle may be formed from various high temperature composite material, which eliminates corrosion. The one piece shuttle also minimizes the number of parts, thus making the backshell adapter assembly less expensive to manufacture.

Figure 1:
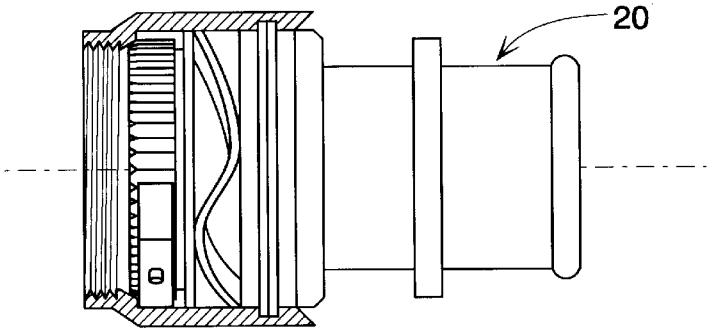
Fig. 1 Prior Art
FIG. 1 is a sectional view of a known backshell adapter assembly.
Figure 2:
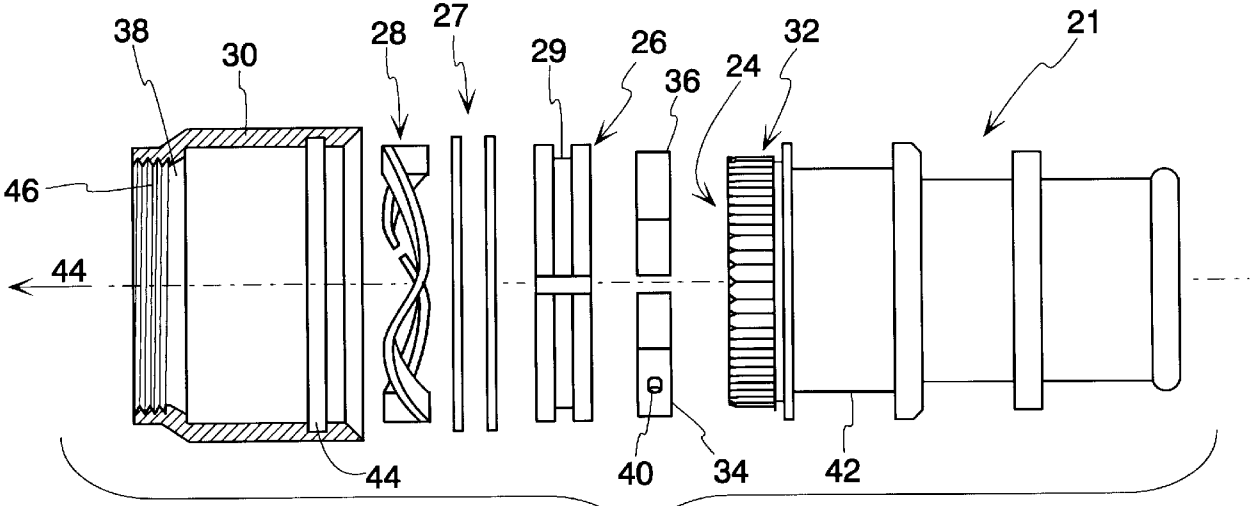
Fig. 2 Prior Art
FIG. 2 is an exploded perspective view partially in section of the backshell adapter assembly illustrated in FIG. 1.
Figures 3, 4:
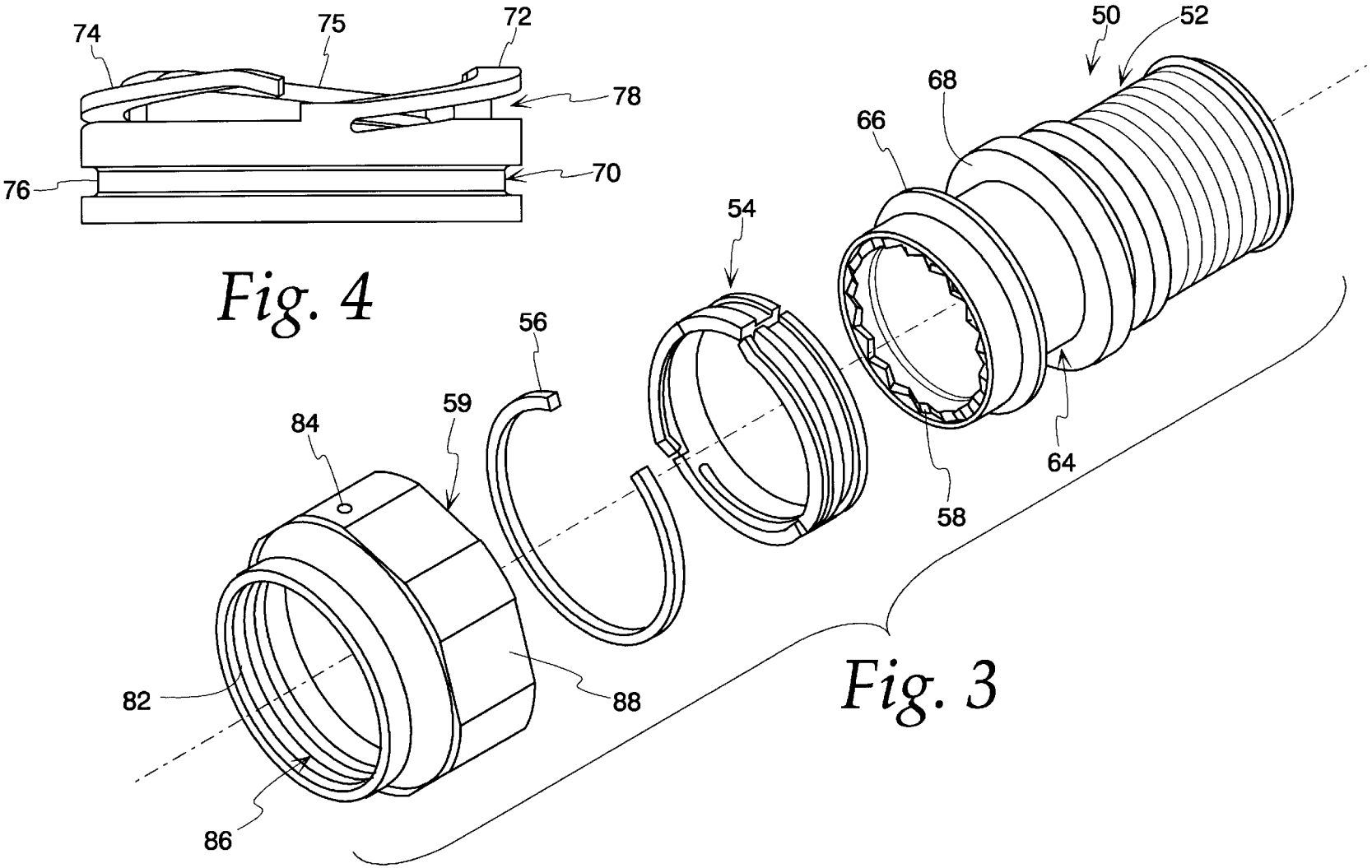
FIG. 3 is an exploded perspective view of the backshell adapter assembly in accordance with the present invention.
FIG. 4 is a front view of the one-piece shuttle mechanism which forms part of the present invention.

Turning to FIGS. 3 and 4, the backshell adapter assembly in accordance with the present invention is generally identified with the reference numeral 50. The backshell adapter assembly 50 includes an adapter body 52, a one piece shuttle mechanism 54, a retaining ring 56 and a coupling nut 58. The adapter body 52 is formed as a generally tubular member with an aperture 56 for receiving a plurality of electrical conductors (not shown). One end of the adapter body 52 is provided with a plurality of interlocking teeth, aligned in an axial direction, disposed around the periphery of the adapter body 52. The interlocking teeth 58 are adapted to mate with corresponding teeth 60 (FIG. 5) on an electrical connector 62. Proper engagement of the interlocking teeth 58 on the adapter body 50 with the interlocking teeth 60 on the connector shell 62 prevent rotation of the adapter body 50 relative to the connector shell 62.

The adapter body 52 also includes an annular retaining grove 64 formed by a pair of spaced apart annular shoulders 66 and 68. The annular retaining grove 64 is adapted to receive the one piece shuttle device 54.

As shown best in FIG. 3, the one piece shuttle 54 is cut across its axial length to enable the one piece shuttle mechanism 54 to be spread out and loaded into the retaining grove 64. In accordance with an important aspect of the invention, the one piece shuttle 54 is adapted to provide an axial force sufficient to overcome any rotational forces on the adapter body 52 to insure proper mating of the interlocking teeth 58 and 60 (FIG. 5) on the adapter body 52 (FIG. 3) and connector shell 52 (FIG. 5) respectively, when the backshell adapter assembly 20 is threaded onto the connector shell 62. In order to reduce the number of parts, the one piece shuttle 54 includes an integrally formed shuttle bushing portion 70 and one or more concentrically formed spring arms 72, 74 and 75. The thrust bushing portion 70 includes an annular retaining grove 76 for receiving the retaining ring 56. As will be discussed in more detail below, the retaining ring 56 is used to capture the coupling nut 58 relative to the adapter body 52.

Figure 5:
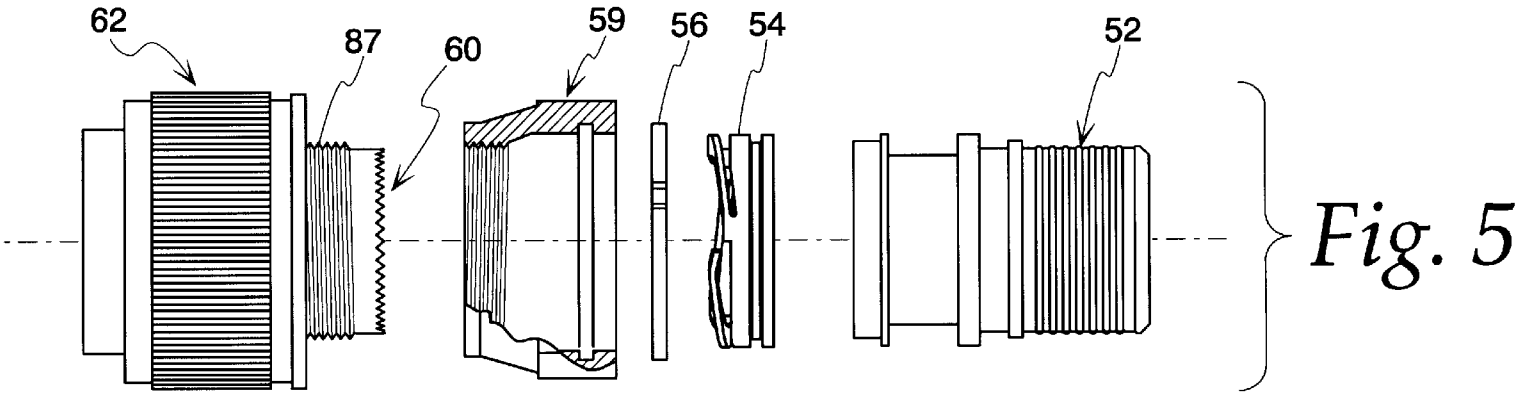
FIG. 5 is an exploded view of the backshell adapter assembly in accordance with the present invention and a conventional electrical connector with a backshell adapter assembly shown partially in sections.

Although three spring arms are illustrated and described, more or less spring arms can be utilized. Each spring arm 72, 74 and 75 is concentrically formed relative to the thrust bushing portion 70 and consists of an arcuate section which corresponds to the curvature of the thrust bushing portion 70. Each arcuate section is connected on one end to the thrust bushing portion 70, as best shown in FIG. 4. The spring arms 72,74 and 75 are formed to extend axially outwardly from the thrust bushing portion 70 defining a gap 78 therebetween. As such, as the backshell adapter assembly 20 is threaded onto the connector shell 62 (FIG. 5), the spring arms 72, 74 and 75 (FIG. 3 and 4) are biased thereby closing the gap 78 to provide an axial biasing force in the direction of the electrical connector shell 62 (FIG. 5).

In accordance with another aspect of the invention, the ends 80 (FIGS. 3 and 4) of the one or more of the spring arms 72, 74 and 75 may be curved radially inwardly toward the thrust bushing portion 70. The bent end portions 80 prevent the spring arms 72,74 and 75 from being flattened out when the coupling nut 52 is fully threaded onto the connector shell 62. As such, the one piece shuttle 54 is adapted to provide a continuous axial force, even when the shuttle 54 stops forward travel and even when the backshell adapter assembly 50 is fully tightened relative to the connector shell 62.

The one piece shuttle 54 may be formed from various composite materials, such as a thermoplastic material, such as Torlon, which is a generic material for Polyamide-imide. Since such thermoplastic materials may be chemically sensitive to certain chemicals, such thermoplastics are normally coated, for example, with nickel.

As discussed above, the retaining ring 56 is used to capture the coupling nut 59 relative to the adapter body 52. The retaining ring 56, may be formed in an arcuate shape conforming to the diameter of the retaining grove 76 and the one piece shuttle 70 defining spaced apart ends which enable easy loading of the retaining ring into the retaining groove 76 on the one-piece shuttle 70. In order to capture the coupling nut 59 relative to the adapter body, the retaining ring 56 may be formed from a composite material as discussed above. The retaining ring 56 is adapted to be received in an annual grove 82 formed in the coupling nut 59. The coupling nut 59 may be provided with one or more apertures 84 which can be used during disassembly of the coupling nut 59 from the adapter body 52.

The coupling nut 59 is provided with a plurality of threads 86 on one end, adapted to mate with corresponding threads 87 (FIG. 5) on the connector shell 62. The coupling nut 59 (FIG. 3) may also be provided with one or more flats 88 to facilitate tightening of the coupling nut 59 onto the connector shell 62 (FIG. 5).

The coupling nut 59 (FIGS. 3 and 4) and retaining ring 56 may be formed from various non-electrically conductive materials, known in the art as engineering polymers. Because of the chemical sensitivity of certain engineering polymers to certain fluids, these polymers are normally coated with, for example, nickel. The adapter body 52 may be formed from various materials, including aluminum or composite material as discussed above.

Figure 6:
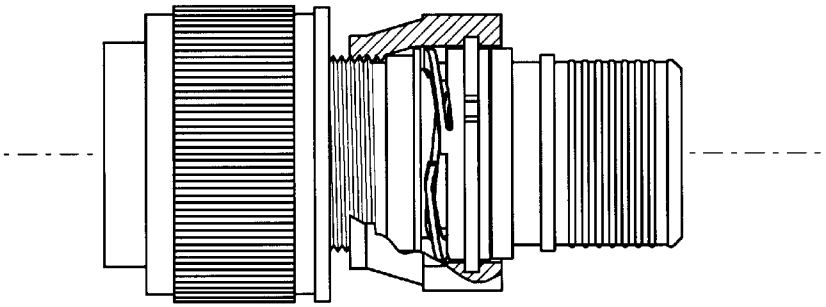
FIG. 6 is similar to FIG. 5 except shown with the coupling nut on the backshell adapter assembly partially threaded onto the electrical connector.
Figure 7:
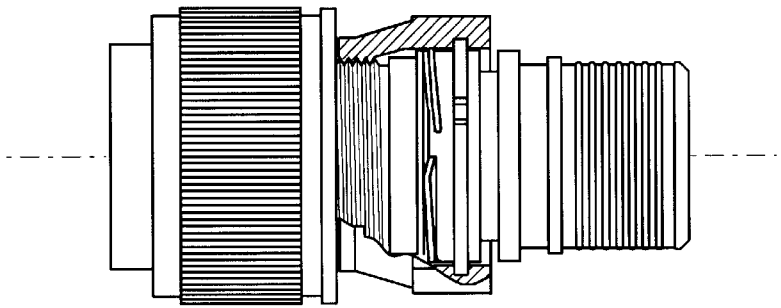
FIG. 7 is similar to FIG. 6 except illustrating the coupling nut fully threaded onto the electrical connector.

The operation of the one piece shuttle 54 is best understood with reference to FIGS. 5, 6 and 7. Initially, as the coupling nut 59 is threaded onto the connector shell 62, the spring arms 72, 74 and 75 are in at rest position, for example, as illustrated in FIG. 5. Once the coupling nut 59 is threaded onto the corresponding threads 87 on the connector shell 62, the spring arms 72,74 and 75 begin to compress against the annular shoulder 66, as generally shown in FIG. 6, thereby providing an axial biasing force in the direction of the connector shell 62, for example, after one turn of the coupling nut 59. The axial biasing force overcomes any radial forces on the adapter body 52 and the teeth 58 on the adapter body 52 (FIG. 3) to properly mate with the corresponding teeth 60 on the connector shell 62. As the coupling nut 59 is tightened against the connector shell 62, the spring arms 72,74 and 75 are compressed as generally shown in FIG. 7, thereby providing a continuous axial biasing force even after the coupling nut 59 is tightened to the connector shell 62. In accordance with an important aspect of the invention, the end portions 80 prevent the spring arms 72, 74 and 75 from being fully flattened out in a fully tightened position as best shown in FIG. 7.

Obviously, many modifications and variations of the present invention are possible in light of the above teachings. Thus, it is to be understood that, within the scope of the appended claims, the invention may be practiced otherwise than as specifically described above.

What is claimed is:

1. A backshell adapter assembly adapted to be connected to an electrical connector having a plurality of axially extending teeth on one end, the backshell adapter assembly comprising:

a generally tubular adapter body formed with a pair of spaced apart annular shoulders defining a first retaining groove said adapter body also formed with a plurality of teeth, axially aligned and formed on one end of said adapter body, said plurality of teeth on said adapter body adapted to mate with said plurality of axially extended teeth on said electrical connector;

a one-piece shuttle, configured to be received in said first retaining groove, said one-piece shuttle formed with a thrush bushing portion and one or more spring arms for providing an axial force when a coupling nut is tightened against said generally tubular adapter body in order to force tooth to tooth engagement of said plurality of teeth on said adapter body with said plurality of axially extending teeth on said electrical connector, said thrust bushing configured with a second retaining groove;

a retaining ring adapted to be received in said second retaining groove; and a coupling nut formed with an annular groove for receiving said retaining ring to prevent axial movement between said adapter body and said coupling nut, said coupling nut also configured to mate on one end with an electrical connector.

2. The backshell adapter assembly as recited in claim 1, wherein said one or more spring arms are formed as arcuate portions connected to one end to said thrust bushing portion.

3. The backshell adapter assembly as recited in claim 2, wherein said one or more spring arms extend axially away from said thrust bushing portion.

4. The backshell adapter assembly as recited in claim 3, wherein one or more ends of said one or more spring arms are bent axially inwardly toward said thrust bushing portion.

5. The backshell adapter assembly as recited in claim 1, wherein said shuttle is formed from a non-metallic material.

6. The backshell adapter as recited in claim 5, wherein said material is a thermoplastic material.

7. A backshell adapter assembly comprising:

a generally tubular adapter body formed with a plurality of axially extending teeth on one end, said axially extending teeth adapted to mate with corresponding axially extending teeth on an electrical connector;

a one-piece shuttle formed with a thrust bushing portion and one or more spring arms, said thrust bushing axially captured relative to said adapter body, said one or more spring arms configured to provide an axial force when a coupling nut is tightened against said generally tubular adapter body in order to force tooth to tooth engagement of said plurality of teeth on said adapter body with said plurality of axially extending teeth on said electrical connector; and a coupling nut configured to mate on one end an electrical connector, said coupling nut axially captured relative to said adapter body.

8. The backshell adapter assembly as recited in claim 7, wherein said one or more spring arms are formed as arcuate portions connected on one end to said thrust bushing portion.

9. The backshell adapter assembly as recited in claim 8, wherein said one or more spring arms extend axially away from said thrust bushing portion.

10. The backshell adapter assembly as recited in claim 9, wherein one or more ends of said one or more spring arms are bent axially inwardly toward said thrust bushing portion.

11. The backshell adapter assembly as recited in claim 7, wherein said shuttle is formed from a non-metallic material.

12. The backshell adapter as recited in claim 11, wherein said material is a thermoplastic material.

13. The backshell adapter assembly as recited in claim 7, wherein said adapter body is formed with a plurality of spaced apart annular shoulders defining a first retaining groove and said one piece shuttle is received in said retaining groove.

14. The backshell adapter assembly as recited in claim 7, wherein said one-piece shuttle is formed with an annular groove defining a second retaining groove and said coupling nut is formed with a annular groove, further including a retaining ring adapted to be received in said second retaining groove and said annular groove formed in said coupling nut for axially capturing said coupling nut relative to said adapter body.

* * * * *

UNITED STATES PATENT AND TRADEMARK OFFICE

CERTIFICATE OF CORRECTION

PATENT NO. : 6,358,077 B1
DATED : March 19, 2002
INVENTOR(S) : Thomas F. Young

It is certified that error appears in the above-identified patent and that said Letters Patent is hereby corrected as shown below:

Title page,
Item [75]: add David W. Tonkiss, Glendale, CA (U.S.) as an inventor.

Signed and Sealed this

Twenty-third Day of September, 2003

JAMES E. ROGAN
*Director of the United States Patent and Trademark Office*